US008302368B1

(12) United States Patent
Keel

(10) Patent No.: US 8,302,368 B1
(45) Date of Patent: Nov. 6, 2012

(54) INTERCONNECTABLE UTILITY POLE MEMBERS

(75) Inventor: Michael Chain Keel, Birmingham, AL (US)

(73) Assignee: McWane Global, Birmingham, AL (US)

( * ) Notice: Subject to any disclaimer, the term of this patent is extended or adjusted under 35 U.S.C. 154(b) by 42 days.

(21) Appl. No.: 12/140,328

(22) Filed: Jun. 17, 2008

(51) Int. Cl.
*F16L 25/14* (2006.01)
*E04C 3/00* (2006.01)

(52) U.S. Cl. ..... 52/843; 52/848; 285/332; 138/120; 138/155

(58) Field of Classification Search ..... 52/831, 52/834, 843, 848, 849, 651.02, 651.07; 403/378, 403/379.3, 379.5; 285/9.2, 332, 332.1, 404; 138/155, 120
See application file for complete search history.

(56) References Cited

U.S. PATENT DOCUMENTS 232,360 A * 9/1880 Milliken ..... 52/848
1,344,779 A * 6/1920 Trammell ..... 285/290.1
1,475,090 A * 11/1923 Taylor ..... 285/261
1,567,369 A * 12/1925 Holst ..... 138/120
1,781,682 A * 11/1930 Crotty ..... 285/295.1
1,810,091 A * 6/1931 Siegle ..... 285/288.1
1,870,770 A * 8/1932 De Witt ..... 52/849
2,457,908 A * 1/1949 Meyerhoefer ..... 285/7
2,679,911 A * 6/1954 Bhend ..... 52/298
3,034,209 A * 5/1962 Bianca et al. ..... 29/432
3,606,403 A * 9/1971 Medney ..... 285/334.4
3,865,498 A * 2/1975 Okuto et al. ..... 403/292
3,936,206 A * 2/1976 Meisberger ..... 403/334
4,405,398 A 9/1983 Rother et al.
4,436,781 A * 3/1984 Rother et al. ..... 428/365
4,482,173 A * 11/1984 Rassieur ..... 285/330
4,569,617 A * 2/1986 Schmidt et al. ..... 405/251
4,769,897 A * 9/1988 Moseman ..... 29/525
5,090,837 A * 2/1992 Mower ..... 403/334
5,180,195 A * 1/1993 Petroff et al. ..... 285/231
5,285,614 A * 2/1994 Fouad ..... 52/848
5,704,187 A 1/1998 Hosford et al.
5,784,851 A 7/1998 Waugh
6,468,003 B2 10/2002 Merjan et al.
7,343,718 B2 3/2008 Foust et al.
8,245,734 B2 * 8/2012 Jahani et al. ..... 138/109
2003/0033281 A1 * 2/2003 Ritz ..... 707/1
2004/0074199 A1 * 4/2004 Gordin et al. ..... 52/726.4
2004/0211148 A1 10/2004 Foust et al.
2005/0017226 A1 * 1/2005 Brittain et al. ..... 254/30
2008/0023172 A1 1/2008 Waugh
2008/0202622 A1 * 8/2008 Cho et al. ..... 138/155

* cited by examiner

*Primary Examiner* — Robert Canfield
*Assistant Examiner* — Babajide Demuren
(74) *Attorney, Agent, or Firm* — C. Brandon Browning; Maynard, Cooper & Gale, PC

(57) ABSTRACT

A metal utility pole including a hollow, centrifugally cast, ductile iron utility pole member having a tapered exterior and variable wall thickness for providing a shortened press-fit, slip joint between interconnected pole members. The shortened joint length requires less metal than conventional press-fit, slip joints while maintaining or improving the overall strength of the joint. This is accomplished by increasing the wall thickness of one or both interconnected pole members along the joint relative to the wall thickness of the body or mid-section of the pole members.

12 Claims, 4 Drawing Sheets

INTERCONNECTABLE UTILITY POLE MEMBERS

FIELD OF THE INVENTION

The present invention relates to a multi-section utility pole and more particularly to a hollow, centrifugally cast, iron utility pole member having a tapered exterior and variable wall thickness for providing a shortened press-fit, slip joint between interconnected pole members.

BACKGROUND OF THE INVENTION

The oldest known method in the art of utility pole construction is the use of wooden poles, such as those commonly used for telephone lines. However, many modern utility pole uses require longer lengths than are practical, or even possible, with wood, and wood poles are highly susceptible to rot, insect infestation, bird attack and high winds. Additionally, construction of wooden poles requires that the pole be of one piece of uncut wood which creates difficulties in transporting and erecting long poles. To overcome the shortcomings of wood utility poles, solid concrete poles are often used. Concrete utility poles, however, are expensive to produce, heavy and require special heavy duty equipment to load, transport, unload and install. Further, the greater weight of concrete poles precludes the use of very long poles. Metal poles have long served as an alternative to wood and concrete utility poles. Metal poles are relatively strong and capable of being constructed in sections for ease of transportation and erection. The widespread use of metal poles however has been limited since steel poles are expensive to produce and aluminum alloy utility poles do not have sufficient strength to be used in high lateral force environments.

More recently, the concept of using ductile iron for utility pole construction has been suggested. It is believed that ductile iron utility poles will provide a virtually maintenance free, extremely long life, low cost utility pole. An exemplary ductile iron utility pole is disclosed in U.S. Patent Application Publication No. 2008/0023172 A2 to Waugh. The pole is a centrifugally cast utility pole having a tapered exterior and a substantially uniform wall thickness along the long axis of the pole. Additionally, U.S. Pat. No. 5,784,851 to Waugh discloses a hollow, centrifugally cast, utility pole having tapered external linear dimensions. The pole is formed utilizing conventional centrifugal casting methods wherein a tapered mold is used to impart a tapered shape to the pole. The use of the tapered mold during the casting operation also provides for a gradually increasing pole wall thickness along the entire length of the pole from the top of the pole to its butt.

Metal utility poles such as the centrifugally cast poles described above are fabricated to provide for a press-fit, slip joint at the butt of the poles which allows the poles to be interconnected with other similarly cast poles for extended height. Such joints however possess several shortcomings. For a conventional press-fit, slip joint between hollow metal pole members, the standard joint length L is about 1.5 times as large as the inner diameter D of the butt of the pole (L/D=1.5). At this joint length, the strength of the joint between pole members is lower than the strength of the remainder of the poles. Further, in order to make the strength of the joint equal to that of the main body of the poles, the joint length must be increased to about twice as large as the inner diameter of the pole (L/D=2.0). However, if the joint length is made about twice as large, the weight of the metal at the joint increases by about 25 percent. Consequently, the cost of manufacturing the pole increases. Lastly, a joint length where L/D=1.5 equates to a large overlap between interconnected pole members, and thus a large amount of wasted utility pole length.

SUMMARY OF THE INVENTION

The present invention is directed to a metal utility pole and in particular to a hollow, centrifugally cast, ductile iron utility pole member having a tapered exterior and variable wall thickness for providing a shortened press-fit, slip joint between interconnected pole members. The shortened joint length requires less metal than conventional press-fit, slip joints while maintaining or improving the overall strength of the joint. This is accomplished by increasing the wall thickness of one or both interconnected pole members along the joint relative to the wall thickness of the body or mid-section of the pole members. This occurs by increasing the pole member wall thickness along the bottom end or butt of a pole member, the top end of the member or both.

DETAILED DESCRIPTION OF PRESENTLY PREFERRED EMBODIMENTS

Figure 1:
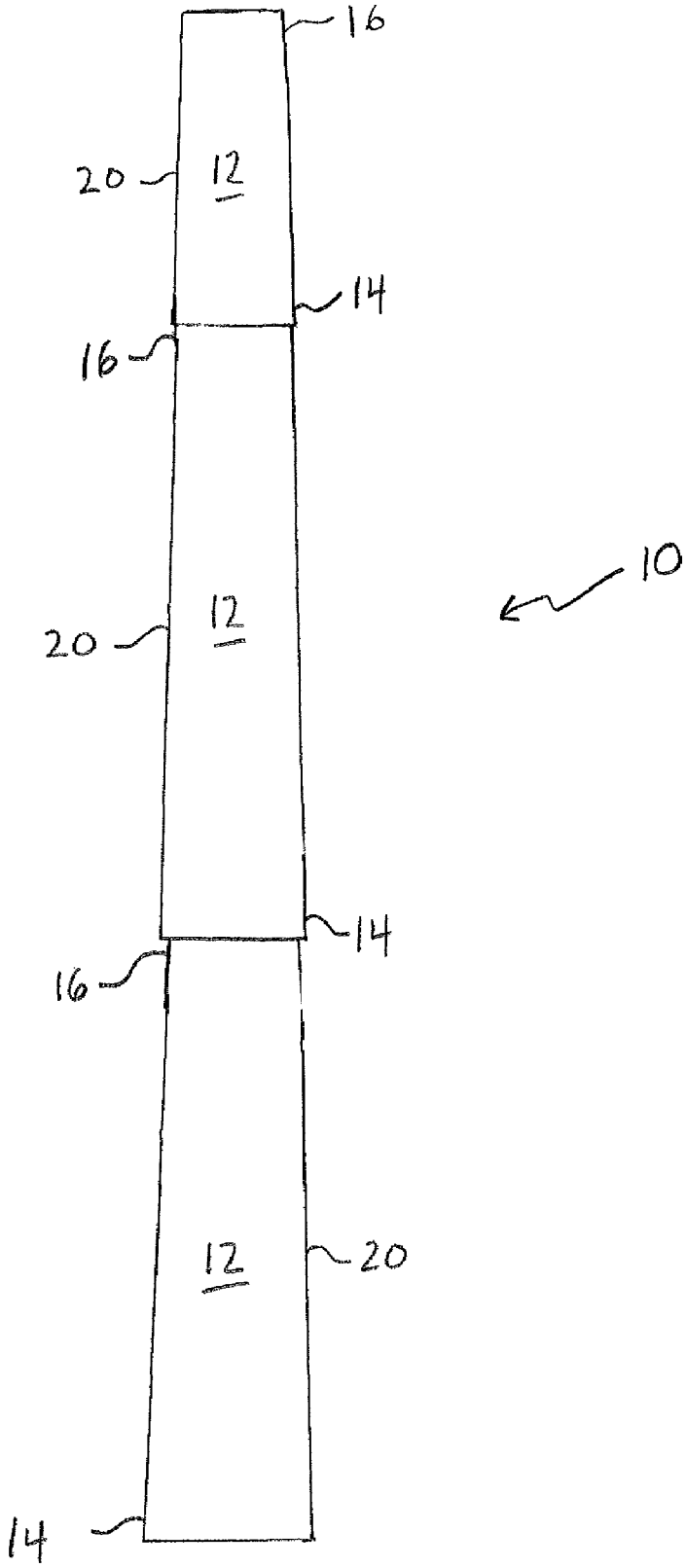
FIG. 1 is an elevational view of a utility pole in accordance with a preferred embodiment of the invention.

FIG. 1 depicts a hollow, utility pole 10 composed of separate and interconnected ductile iron, pole members 12 in accordance with the preferred embodiment of the present invention, each of members 12 having a tapered exterior shape. Preferably, pole members 12 are centrifugally cast using methods well known in the art. Other less well known methods can also be used including, for example, the centrifugal casting methods described in U.S. Patent Application Publication No. 2008/0023172 A2 and U.S. Pat. No. 5,784,851. As shown, utility pole 10 is built by stacking pole members 12, end to end, with a bottom end section 14 of one pole member 12 being supported directly on top of and overlapping a top end section 16 of another pole member 12. The overlap portion defines a slip joint between interconnected pole members 12 having a joint length L.

It has been found that by providing pole members 12 with a variable wall thickness, as specifically described herein, the joint length L between interconnected pole members 12 can be shortened while decreasing the amount of metal at the joint. It has also been found that the slip joints of the present invention, having a shortened joint length L, exhibit a joint strength that is substantially equal to or greater than conventional slip joint strengths between similarly designed metal pole members. In particular, according to the present invention, the strength along a slip joint can be maintained, i.e., be substantially equal to that of a similar joint having where joint length L is 1.5 times the inner diameter of the bottom end section, when the joint length L between interconnected pole members 12 is less than 1.2 times an inner diameter of the bottom end section 14 forming the joint. A preferred joint length, according to the present invention, is between 1.1 to 0.6 times the inner diameter of bottom end section 14, and a more preferred joint length L is between 1.0 and 0.8 times the inner diameter of bottom end section 14.

Figure 2:
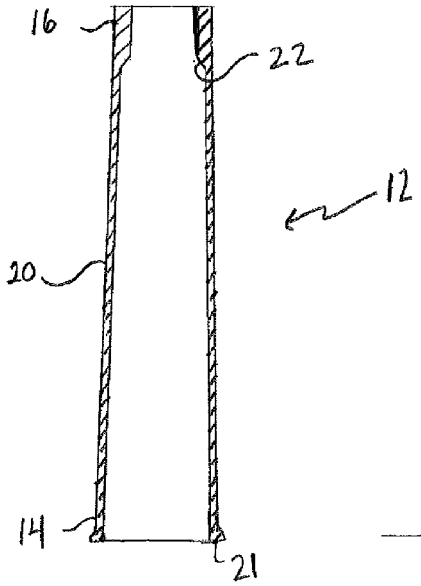
FIG. 2 is a sectional view of a utility pole member in accordance with a preferred embodiment of the invention, the pole member having an increased wall thickness at the top end section thereof.
Figure 3:
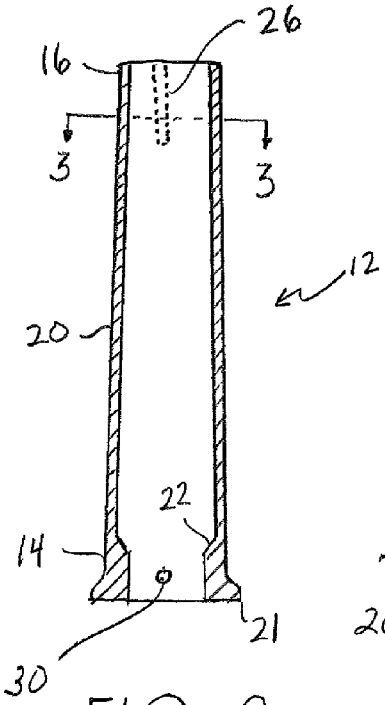
FIG. 3 is a sectional view of a utility pole member in accordance with a preferred embodiment of the invention, the pole member having an increased wall thickness at the bottom end section thereof.
Figure 4:
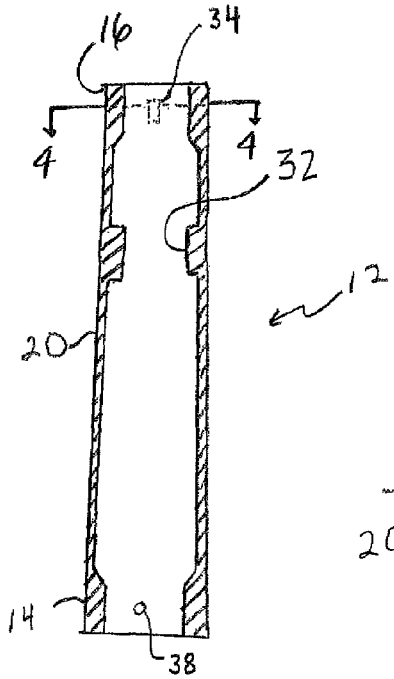
FIG. 4 is a sectional view of a utility pole member in accordance with a preferred embodiment of the invention, the pole member having an increased wall thickness at the bottom and top end sections thereof.

The decreased joint length L of the present invention is accomplished by increasing the wall thickness of one or both interconnected pole members 12 along the joint relative to the wall thickness of a midsection 20 of pole members 12. As depicted in FIGS. 2 through 4, this can occur by increasing pole member 12 wall thickness along bottom end section 14 of pole member 12, top end section 16 of member 12 or both. What is required that the sum of the wall thickness W about the joint, i.e, the wall thickness of top end section 16 plus the wall thickness of bottom end section 14, is greater than either twice a wall thickness of midsection 20 of one of interconnected pole members 12, or the combined wall thicknesses of midsection 20 of both interconnected pole members 12. Preferably, the combined wall thicknesses W of bottom end section 14 and top end section 16 of interconnected pole members 12 about the joint formed there between is in the range of 5% to 20% greater, or more preferably in the range of 7% to 15% greater, or even more preferably in the range of 9% to 11% greater, than either twice the wall thickness of midsection 20 of one pole member 12 or the sum of the wall thickness of midsection 20 of both interconnected pole members 12.

Figure 2A:
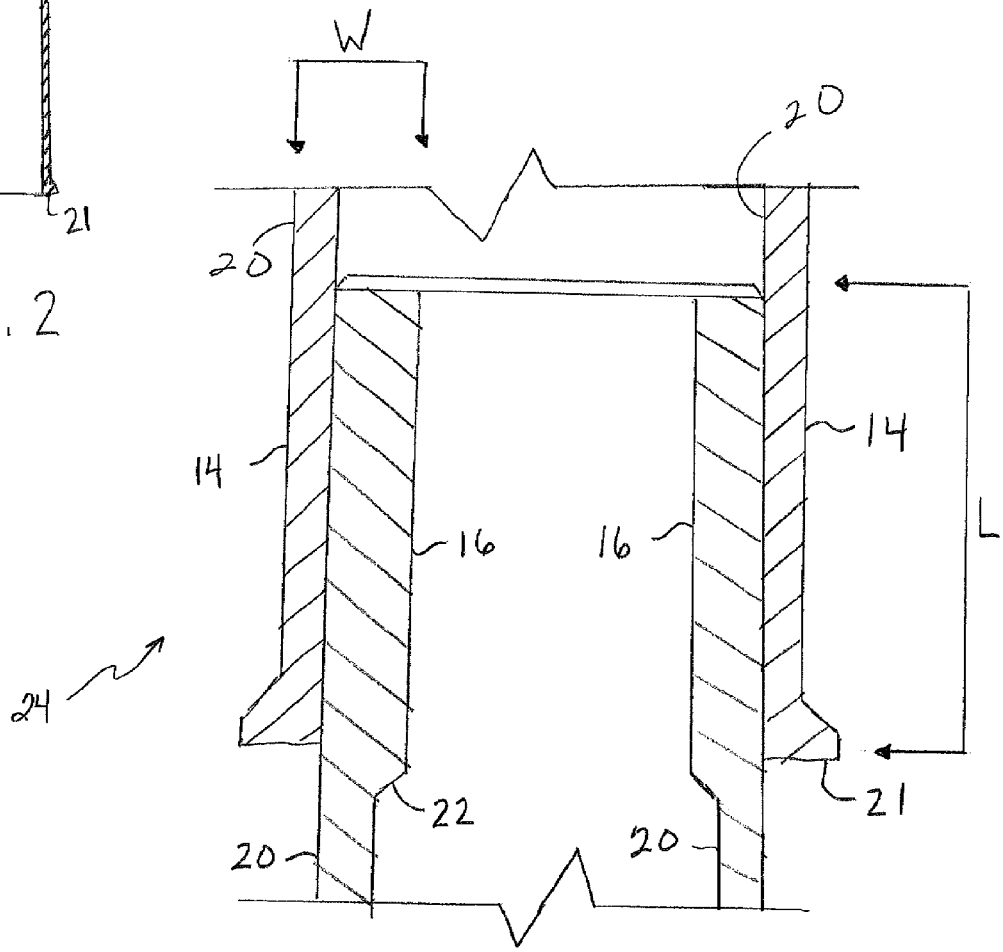
FIG. 2*a* is a sectional view of a slip joint formed between two of the utility pole members of FIG. 2.

More particularly, FIG. 2 depicts a pole member 12 including a top end section 16 having an increased wall thickness relative to a thickness of a midsection 20 and a bottom end section 14 of member 12. As shown, the wall thickness of midsection 20 and the wall thickness of bottom end section 14 are substantially equal and uniform along the entire lengths thereof, with the exception of a flanged portion 21 about the free end of section 14. A transition section 22 distinguishes top end section 16 from midsection 20 of member 12. Top end section 16 preferably has a uniform thickness although it is contemplated that the wall thickness can vary, for example, if required to form an improved slip joint with an interconnected pole 12. FIG. 2*a* depicts a press fit, slip joint 24 formed between two pole members of the type illustrated in FIG. 2. Slip joint 24 has a joint length L that is equal to the distance top end portion 16 extends into bottom end section 14. The joint further includes a total wall thickness W formed by the sum of the wall thicknesses of top end section 16 and bottom end section 14. In this embodiment, the length of top end section 16 is greater than joint length L, although they may be substantially the same.

Figure 3B:
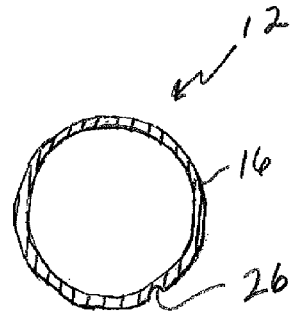
FIG. 3*b* is a sectional view of the utility pole of FIG. 3 through line 3-3.
Figure 3A:
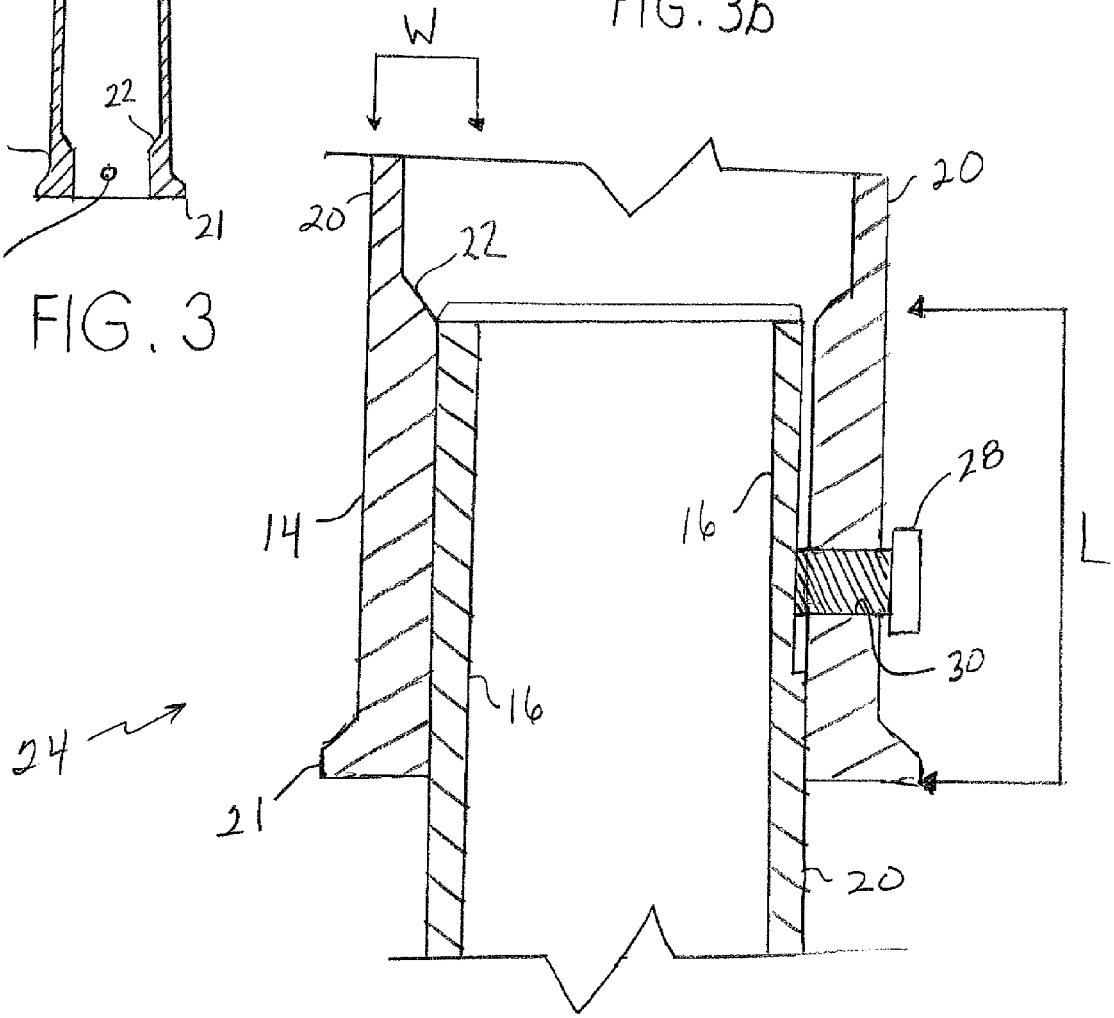
FIG. 3*a* is a sectional view of a slip joint formed between two of the utility pole members of FIG. 3.

FIG. 3 depicts a pole member 12 including a bottom end section 14 having an increased wall thickness relative to a thickness of a midsection 20 and a top end section 16 of member 12. As shown, the wall thickness of midsection 20 and the wall thickness of top end section 16 are substantially equal and uniform along the entire lengths thereof. A transition section 22 distinguishes bottom end section 14 from midsection 20 of member 12. Bottom end section 14 preferably has a uniform thickness, excluding the flanged portion 21, although it is contemplated that the wall thickness can vary, for example, if required to form an improved slip joint with an interconnected pole 12. FIG. 3*a* depicts a press fit, slip joint 24 formed between two pole members of the type illustrated in FIG. 3. Slip joint 24 has a joint length L and a total wall thickness W. In this embodiment, the length of bottom end section 14 is substantially equal to joint length L, although they may be different. As shown in FIGS. 3, 3*a* and 3*b*, in order to further secure top end section 16 within bottom end section 14, for example during shipping, at least one longitudinally extending slot 26 can be provided within the exterior of top end section 16 for receiving the end of a screw 28 inserted through a hole 30 in bottom end section 14. In particular, once top end section 16 is inserted into bottom end section 14 and a press fit, slip joint is formed there between, screw 28 is inserted into hole 30 and turned in order to press the end of screw 28 into slot 26 and against the exterior of pole member 12.

Figure 4B:
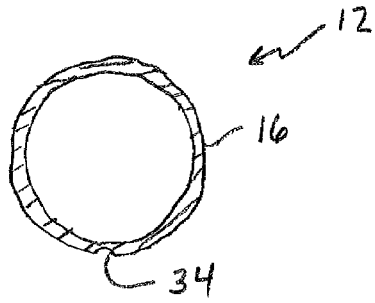
FIG. 4*b* is a sectional view of the utility pole of FIG. 4 through line 4-4.
Figure 4A:
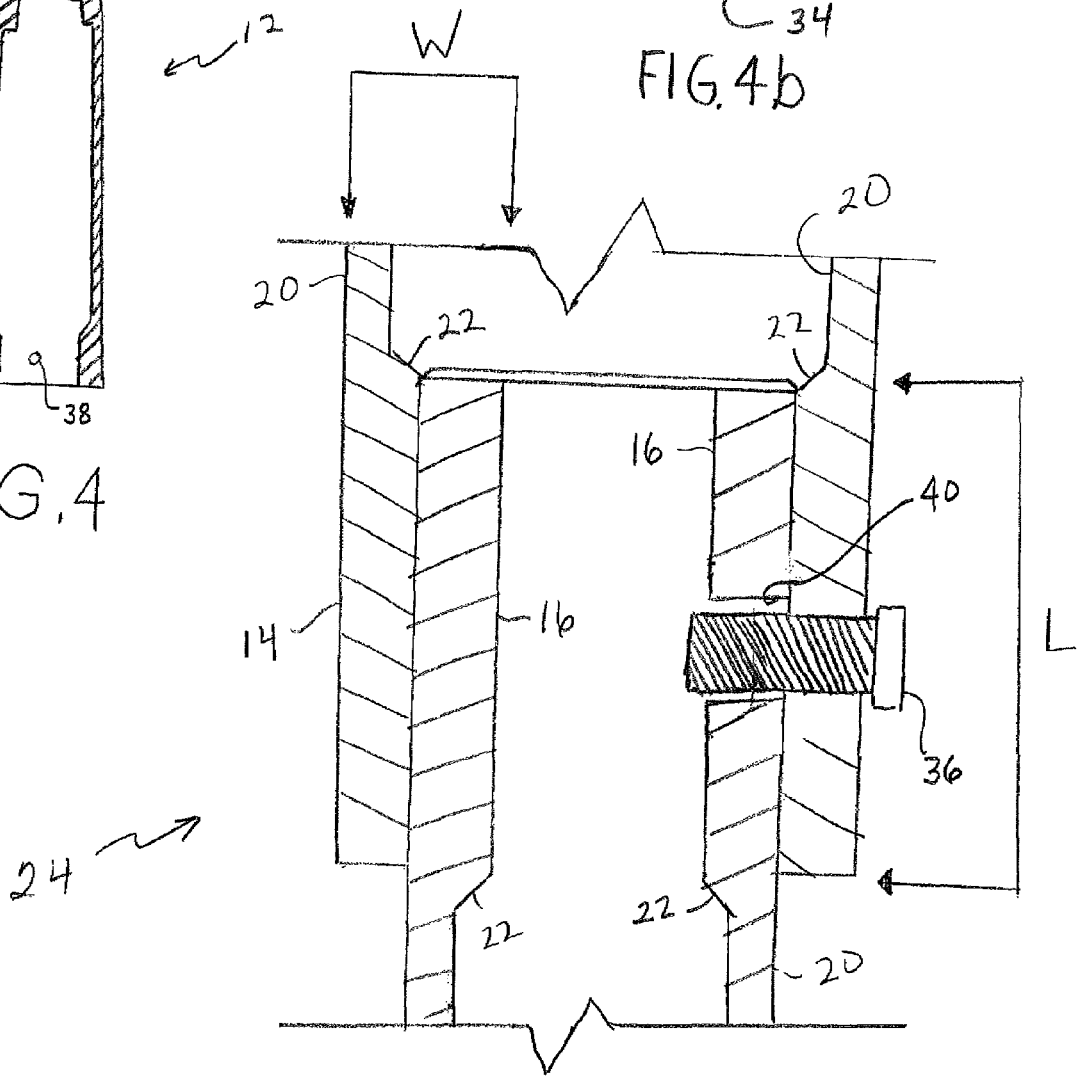
FIG. 4*a* is a sectional view of a slip joint formed between two of the utility pole member of FIG. 4.

FIG. 4 depicts a pole member 12 including a bottom end section 14 and a top end section 16 each having an increased wall thickness relative to a thickness of a midsection 20 of member 12. As shown, the wall thickness of midsection 20 is substantially uniform along the entire length thereof, with the exception of an attachment point 32 for connecting a fixture to the exterior of utility pole member 12. Attachment point 32 has an increased wall thickness relative to the wall thickness of midsection 20 and may extend partially around the circumference of member 12, as shown, or completely there around. A transition section 22 distinguishes bottom end section 14 and top end section 16 from midsection 20 of member 12. FIG. 3*a* depicts a press fit, slip joint 24 formed between two pole members of the type illustrated in FIG. 4. Slip joint 24 has a joint length L and a total wall thickness W formed by the sum of the wall thicknesses of top end section 16 and bottom end section 14. In this embodiment, the length of bottom end section 14 is substantially equal to joint length L, although they may be different. Also, the length of the top end section is greater than the joint length L. As shown in FIGS. 4, 4*a* and 4*b*, in order to further secure top end section 16 within bottom end section 14, at least one slot 34 can be provided within the exterior of top end section 16 for receiving the end of a screw 36 inserted through a hole 38 in bottom end section 14. In particular, once top end section 16 is inserted into bottom end section 14 and a press fit, slip joint is formed there between, screw 36 is inserted into hole 38 and turned in order to press the end of screw 36 into slot 34 and against the exterior of pole member 12. Unlike slot 26 depicted in FIG. 3, slot 34 does not extend to the end of top end section 16 but rather has a top edge 40. Top edge 40 provides an upper limit within which screw 36 can travel along pole the exterior of section 16.

In certain instances, it may be preferred that press fit, slip joint 24 formed between bottom end section 14 and top end section 16 exhibits a precise or friction fit between sections 14 and 16. This requires that the inner surface of bottom end section 14 has a shape and diameter along the length thereof that are complimentary and nearly identical to the shape and diameter of the outer surface of top end section 16 along its length. To accomplish this arrangement, bottom end section 24 is initially cast to have an inner diameter along its length that it somewhat smaller than the outer diameter of top end section 16. In this configuration, top end section 16 would not fit into bottom end section 14 in manner to provide an operational joint. In order to configure bottom end section 14 in a manner to precisely receive top end section 16, bottom end section 14 is stretched so that its inner and outer diameters are increased proportionately. This is done by pressing a preformed member having a portion that includes sidewalls that are identical in shape, length and diameter to the shape, length and diameter of the outer surface of top end section 16 into bottom end section 14 thereby imparting the exterior shape and diameter of the member to the inner surface of bottom end section 14. In particular, the preformed member is inserted into bottom end section 14 immediately following the heating step of the annealing process during the manufacture of utility pole member 12. This is done using a hydraulic actuated rod that forces the member into bottom end section 14. As the member rides along the inner surface of bottom end section 14 and presses there against, bottom end section 14 is expanded or pushed outward such that the outer and inner diameters of bottom end section 14 are increased. This can cause a flaring of bottom end section 14. Once the preformed member is pressed into bottom end section 14 the appropriate distance for imparting to the inner surface of bottom end section 14 the desired shape and diameter, the member is retracted, and utility pole member 12 is cooled.

As will be apparent to one skilled in the art, various modifications can be made within the scope of the aforesaid description. Such modifications being within the ability of one skilled in the art form a part of the present invention and are embraced by the claims below. For example, in the event it is desired to provide a slip joint having a strength greater than found in conventional slip joints, joint length L can be increased to greater than 1.5 times the inner diameter of bottom end section 14. Additionally, when both top end section 16 and bottom end section 14 have a wall thickness that is greater than the wall thickness of midsection 20, they can have the same of different wall thicknesses. Also, for certain applications, it may be necessary for either top end section 16 or bottom end section 14 to have a wall thickness that is less than the midsection 20 wall thickness.

It is claimed:

1. A utility pole comprising:

a hollow, centrifugally cast ductile, iron pole member having an externally tapered shape, a top end section having a first wall thickness, a bottom end section having a second wall thickness and being configured for forming a rigid, press-fit, slip joint with a second pole member, and a middle section having a substantially uniform third wall thickness, wherein a sum of the first wall thickness and the second wall thickness is greater than twice the third wall thickness, wherein the externally tapered shape extends to and between the top end section and the bottom end section, wherein each of the top end section and the bottom end section excludes a facing for ensuring direct contact between the hollow, centrifugally cast ductile, iron pole member and the second pole member along the rigid, press-fit, slip joint, and wherein the third wall thickness is less than the first wall thickness and less than the second wall thickness.

2. A utility pole comprising:

a hollow, centrifugally cast ductile, iron pole member having an externally tapered shape, a top end section having a first wall thickness, a bottom end section having a second wall thickness and being configured for forming a rigid, press-fit, slip joint with a second pole member, and a middle section having a substantially uniform third wall thickness, wherein a sum of the first wall thickness and the second wall thickness is greater than twice the third wall thickness, and wherein the externally tapered shape extends to and between the top end section and the bottom end section, wherein the top end section and the bottom end section exclude a facing for ensuring direct contact between the hollow, centrifugally cast ductile, iron pole member and the second pole member along the rigid, press-fit, slip joint, and wherein the first wall thickness and the second wall thickness are substantially equal.

3. The pole according to claim 1 wherein the first wall thickness is greater than the second wall thickness.

4. The pole according to claim 1 wherein the second wall thickness is greater than the first wall thickness.

5. The pole according to claim 1 wherein the second pole member has a tapered exterior shape.

6. The pole according to claim 1 wherein the press-fit, slip joint has a length that is less than about 1.2 times an inner diameter of the bottom end section.

7. The pole according to claim 1 wherein the press-fit, slip joint has a length that is between 1.0 and 1.25 times an inner diameter of the bottom end section.

8. The pole according to claim 1 wherein the sum of the first wall thickness and the second wall thickness is between about 7 percent and 15 percent greater than twice the third wall thickness.

9. The pole according to claim 2 wherein the second pole member has a tapered exterior shape.

10. The pole according to claim 2 wherein the press-fit, slip joint has a length that is less than about 1.2 times an inner diameter of the bottom end section.

11. The pole according to claim 2 wherein the press-fit, slip joint has a length that is between 1.0 and 1.25 times an inner diameter of the bottom end section.

12. The pole according to claim 2 wherein the sum of the first wall thickness and the second wall thickness is between about 7 percent and 15 percent greater than twice the third wall thickness.

* * * * *